United States Patent [19]

Jackson

[11] Patent Number: 4,990,308

[45] Date of Patent: Feb. 5, 1991

[54] CHROMIUM CONTAINING HIGH TEMPERATURE NB—TI—AL ALLOY

[75] Inventor: Melvin R. Jackson, Schenectady, N.Y.

[73] Assignee: General Electric Company, Schenectady, N.Y.

[21] Appl. No.: 280,085

[22] Filed: Dec. 5, 1988

[51] Int. Cl.[5] ..... C22C 27/02

[52] U.S. Cl. ..... 420/426; 148/133; 420/425

[58] Field of Search ..... 420/425, 426; 148/133

[56] References Cited

U.S. PATENT DOCUMENTS

| | | | |
|---|---|---|---|
| 2,838,396 | 6/1958 | Rhodin, Jr. | 420/425 |
| 2,940,845 | 6/1960 | Jaffee et al. | 75/174 |
| 3,001,870 | 9/1961 | McCullough et al. | 75/174 |
| 3,028,236 | 4/1962 | Wlodek et al. | 420/425 |

FOREIGN PATENT DOCUMENTS

| | | |
|---|---|---|
| 1175638 | 5/1957 | France . |
| 436880 | 7/1974 | U.S.S.R. . |

OTHER PUBLICATIONS

Alloys of Niobium, Prokoshkin et al., Daniel Davey & Co., N.Y., 1965, pp. 136 and 173.

*Primary Examiner*—Upendra Roy

*Attorney, Agent, or Firm*—Paul E. Rochford; James C. Davis, Jr.; James Magee, Jr.

[57] ABSTRACT

An alloy having a niobium titanium base and aluminum and chromium additives is provided. The alloy has superior strength and ductility at high temperatures. The composition is as follows:

| Ingredient | Concentration in Atomic Percent From | To |
|---|---|---|
| Nb | balance | |
| Ti | 32 | 48 |
| Al | 8 | 16 |
| Cr | 2 | 12 |

4 Claims, 5 Drawing Sheets

CHROMIUM CONTAINING HIGH TEMPERATURE NB—TI—AL ALLOY

CROSS REFERENCE TO RELATED APPLICATION

The subject application relates to application Ser. No. 202,357, filed June 6, 1988. It also relates to application Ser. No. 290,399 (attorney docket RD-19,131), filed 12-29-88; to application Ser. No. 279,640 (attorney docket D-18,672), filed 12-5-88; to Ser. No. 279,639 (attorney docket RD-19,130), filed 12-5-88; and to Ser. No. 288,394 (attorney docket RD-19,130) filed 12-22-88. The text of the related applications is incorporated herein by reference.

BACKGROUND OF THE INVENTION

The present invention relates generally to alloys and to shaped articles formed for structural use at high temperatures. More particularly, it relates to an alloy having a niobium titanium base and which contains a chromium additive. By a niobium titanium base is meant that the principal ingredients of the alloy are niobium and titanium.

There are a number of uses for metals which have high strength at high temperature. One particular attribute of the present invention is that it has, in addition to high strength at high temperature, a relatively low density of the order of 6–6.5 grams per cubic centimeter (g/cc).

In the field of high temperature alloys and particularly alloys displaying high strength at high temperature, there are a number of concerns which determine the field applications which can be made of the alloys. One such concern is the compatibility of an alloy in relation to the environment in which it must be used. Where the environment is the atmosphere, this concern amounts to a concern with the oxidation or resistance to oxidation of the alloy.

Another such concern is the density of the alloy. One of the groups of alloys which is in common use in high temperature applications is the group of iron-base, nickelbase, and cobalt-base superalloys. The term "base", as used herein, indicates the primary ingredient of the alloy is iron, nickel, or cobalt, respectively. These superalloys have relatively high densities of the order of 8 to 9 g/cc. Efforts have been made to provide alloys having high strength at high temperature but having significantly lower density.

It has been observed that the mature metal candidates for use in this field can be grouped and such a grouping is graphically illustrated in FIG. 1. Referring now to FIG. 1, the ordinate of the plot shown there is the density of the alloy and the abscissa is the maximum temperature at which the alloy provides useful structural properties for aircraft engine applications. The prior art alloys in this plot are discussed in descending order of density and use temperatures.

With reference to FIG. 1, the materials of highest density and highest use temperatures are those enclosed within an envelope marked as Nb-base and appearing in the upper right hand corner of the figure. Densities range from about 8.7 to about 9.7 grams per cubic centimeter and use temperatures range from less than 2200° F. to about 2600° F.

Referring again to FIG. 1, the group of prior art iron, nickel, and cobalt based superalloys are seen to have the next highest density and also a range of temperatures at which they can be used extending from about 500° F. to about 2200° F.

A next lower density group of prior art alloys are the titanium-base alloys. As is evident from the figure, these alloys have a significantly lower density than the superalloys but also have a significantly lower set of use temperatures ranging from about 200° F. to about 900° F.

The usefulness of the titanium-base alloys extends over a temperature range which is generally higher than thatof the aluminum-base alloys but lower than that of the superalloys. Within this temperature range different properties are achieved.

The last and lowest density group of prior art alloys are the aluminum-base alloys. As is evident from the graph these alloys generally have significantly lower density. They also have relatively lower temperature range in which they can be used, because of their low melting points.

A novel additional set of alloys is illustrated in the figure as having higher densities than those of the titanium-base alloys, but much lower densities than those of the superalloys, but with useful temperature ranges potentially extending beyond the superalloy temperature range. These ranges of temperature and density include those for the alloys such as are provided by the present invention and which are formed with a niobium titanium base.

BRIEF STATEMENT OF THE INVENTION

It is, accordingly, one object of the present invention to provide an alloy system which has substantial strength at high temperature relative to its weight.

Another object is to reduce the weight of the elements presently used in higher temperature applications.

Another object is to provide an alloy which can be employed where high strength is needed at high temperatures.

Other objects will be in part apparent and in part pointed out in the description which follows.

In one of its broader aspects, objects of the present invention can be achieved by forming a chromium containing alloy consisting essentially of the following ingredient composition:

| Ingredient | Concentration in Atomic % From | To |
|---|---|---|
| Niobium | essentially balance | |
| Titanium | 32 | 48 |
| Aluminum | 8 | 16 |
| Chromium | 2 | 12 |

Because of the influence of titanium on the solubility of aluminum and chromium, the sum of the concentrations of these two elements in the composition above must be equal to or less than 22 atomic percent. Similarly, where the titanium concentration is less than 37 atomic percent, the sum of the concentrations of aluminum and chromium must be equal to or less than 16 atomic percent. These two provisos to the composition may be written as follows: provided that the sum $(Al+Cr) \leqq 22$ a/o, and provided that where Ti is less than 37 a/o, the sum of $(Al+Cr) \leqq 16$ a/o.

The phrase "balance essentially niobium", is used herein to include, in addition to niobium in the balance of the alloy, small amounts of impurities and incidental elements, which in character and/or amount do not adversely affect the advantageous aspects of the alloy.

The above-recited ranges for the ingredients of this alloy cover the useable ranges in which the ingredients are changed in their proportions. Generally, if the useful properties sought are higher temperature properties, it is preferred to keep the range of niobium higher. In this case, the ratio of titanium to niobium will be relatively low and in the order of about 0.6. When the ratio of titanium to niobium is lower, the solubilities of the aluminum and chromium additives are also lower and, for this reason, the concentration of aluminum and chromium should be in the lower ranges. The influence of the changes in the concentrations and the ratios of the alloy ingredients may be described with reference to FIG. 1 and particularly for the envelope illustrated in FIG. 1 and labeled Nb/Ti base. The alloys having the lower ratio of titanium to niobium in the range of about 0.6 have densities which range from about 6.1 to about 6.6 and have useful operating temperatures which range from about 1800° F. to about 2500° F.

By contrast, if the ratio of titanium to niobium is higher then alloys which result have very desirable combinations of density and operating temperature but the temperature range for their operation is at the lower to middle range of the envelope labelled Nb/Ti base of FIG. 1. For example, if the alloy has a titanium to niobium ratio up to about 1.5, the useful temperature range would be from about 1000° F. to about 1500° F. Also, these alloys have densities in the range of 5.7 to about 6.1. For the alloys having the higher ratio of titanium to niobium, the solubility of the aluminum and chromium additives is higher and, accordingly, higher concentrations of aluminum and chromium can be accommodated in these alloys. The aluminum and chromium additives are beneficial as is evidenced in the subject specification, because there is a lower net density from the addition of these elements. In addition to the lower density, the incorporation of aluminum and chromium additives increased the specific strength of the alloy in preferred operating temperatures for these alloys with the higher additives in the temperature ranges of about 1000° F. to about 1500° F.

BRIEF DESCRIPTION OF THE DRAWINGS

The present invention will be understood more clearly by reference to the accompanying figures in which.

DETAILED DESCRIPTION OF THE INVENTION

Figure 1:
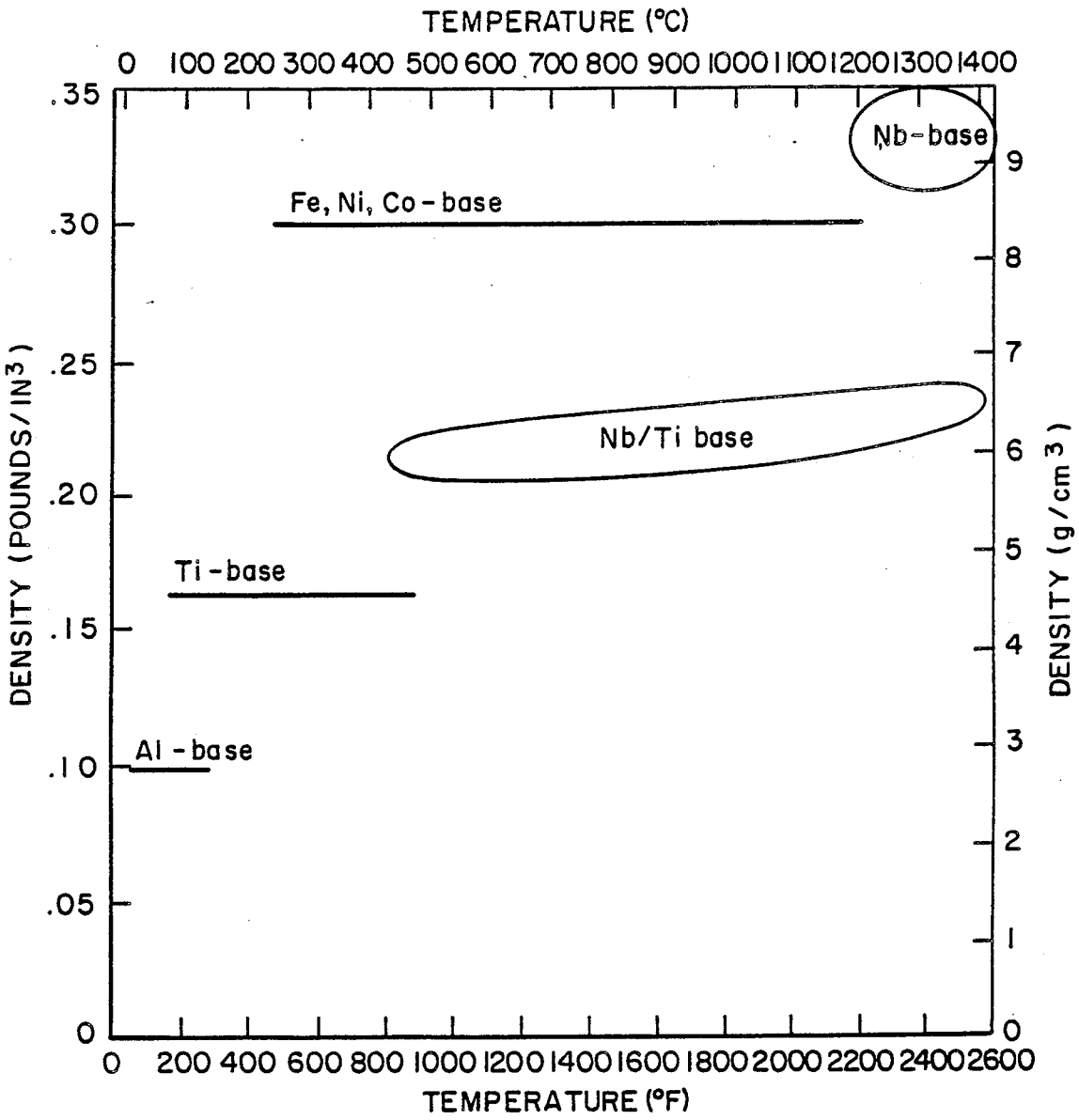
FIG. 1 is a reference plot for comparison of alloys by use temperature and by density in which the ranges of prior art alloys and of Nb/Ti base alloys may be compared.

It is known that intermetallic compounds, that is, metal compositions in which the ingredients are at concentration ratios which are very close to stoichiometric ratios, have many interesting and potentially valuable properties. However, many of these intermetallic compounds are brittle at lower temperatures or even at high temperatures and, for this reason, have not been used industrially. It is valuable to have alloy compositions which are not dependent on the intermetallic ratios of ingredients and which have good ductility at elevated temperatures and also at moderate and lower temperatures. What is even more valuable is an alloy composition, ingredients of which can be varied over a range and which have both high strength at higher temperatures and also good ductility over a range of temperatures. The compositions of the present invention meet these criteria. The temperature range of which they are useful extends from less than 2000° F. to over 2500° F.

It is well known that a commercial superconductive alloy contains about 46.5 wt. % of titanium (about 63 atomic % titanium) in a niobium base. This alloy is used as a basis for comparison with the Nb-Ti base alloys of this invention.

EXAMPLE 1

A sample of this alloy was prepared by arc casting and tests of the as-cast alloy properties were made. In this and all subsequent testing of alloy specimens of the examples, conventional metallurgical testing methods were employed and the test results are given in standard measurement units such as yield strength (YS); ultimate tensile strength (UTS); uniform elongation (e Uniform); elongation at failure (e Failure); and reduction in area (RA). The test results are given in Table I below:

TABLE I

| Testing Temperature | YS | UTS | e Failure | RA |
|---|---|---|---|---|
| 70° F. (23° C.) | 90 ksi | 91 ksi | 3% | 5% |
| 1110° F. (600° C.) | 16 | 25 | 14 | 17 |
| 1650° F. (900° C.) | 9 | 9 | 60 | 61 |
| 2190° F. (1200° C.) | 5 | 5 | 64 | 49 |

The alloy was also tested for rupture resistance at 3 ksi and 2100° F. in an argon atmosphere. The sample had not failed after 285 hours. This alloy has a nominal density of 6.02 grams per cubic centimeter. However, the strength of this material is quite low in the 1100° to 2000° F. temperature range. Accordingly, it is not an attractive alloy for use as an airfoil fabricating material or for other structural uses at high temperature.

EXAMPLE 2

An alloy was prepared by arc casting to contain 45 at. % of niobium, 45 at. % of titanium and 10 at. % of aluminum. No heat treatment or mechanical deformation was done to the arc cast metal sample. Test bars were prepared from the as-cast alloy. Tests were run at the temperatures indicated in Table II below and the results obtained are those which are listed in the Table.

TABLE II

| Testing Temperature | 45/45/10 YS | UTS | e Failure | RA |
|---|---|---|---|---|
| 70° F. | 91 ksi | 97 ksi | 33% | 40% |
| 1110° F. | 53 | 56 | 34 | 54 |
| 1650° F. | 18 | 18 | 116 | 92 |
| 2190° F. | 5 | 5 | 143 | 93 |

The density of this alloy was determined to be 6.33 g/cc. It is evident from Table II that there is a substantial improvement in the tensile properties of the specimen prepared to contain the aluminum in addition to the niobium and titanium according to the ratio of 45 niobium, 45 titanium and 10 aluminum when compared to the conventional niobium-titanium alloy of Example 1.

EXAMPLE 3

An alloy was prepared by arc casting to contain 40 at. % of niobium, 40 at. % of titanium and 20 at. % of aluminum. Again, no heat treatment or mechanical deformation was accorded the alloy. Test bars were machined from the as-cast alloy as was done in Examples 1 and 2 and tests were performed using these test bars. The results are given in Table III.

TABLE III

| Testing Temperature | YS | UTS | e Failure | RA |
|---|---|---|---|---|
| 70° F. | 135 ksi | 135 ksi | 15% | 50% |
| 110° F. | 89 | 91 | 13 | 14 |
| 1650° F. | 55 | 66 | 2.3 | 4.4 |
| 2190° F. | 4 | 4 | 120 | 93 |

From the data tabulated in Table II it is evident that the 40/40/20 niobium-titanium-aluminum alloy of this example has yield strength the properties which are improved over those of the 45/45/10 alloy. The density of the alloy was found to be 5.95 g/cc.

EXAMPLE 4

The procedure of Example 3 was used and an alloy was arc cast to contain 40 at. % of niobium, 40 at. % of titanium, 10 at. % of aluminum and 10 at. % of chromium. No heat treatment or mechanical deformation was accorded the alloy. Test bars were prepared and tested. The results of the tests are given in Table IV below:

TABLE IV

| Testing Temperature | YS | UTS | e Failure | RA |
|---|---|---|---|---|
| RT | 142 ksi | 143 ksi | 14% | 29% |
| 1110° F. | 94 | 107 | 24 | 50 |
| 1400° F. | 84 | 85 | 35 | 49 |
| 1650° F. | 35 | 36 | 180 | 91 |
| 1795° F. | 23 | 23 | 166 | 91 |
| 2190° F. | 8 | 8 | 153 | 94 |

The sample was found to have a density of 6.35 g/cc.

Figure 2:
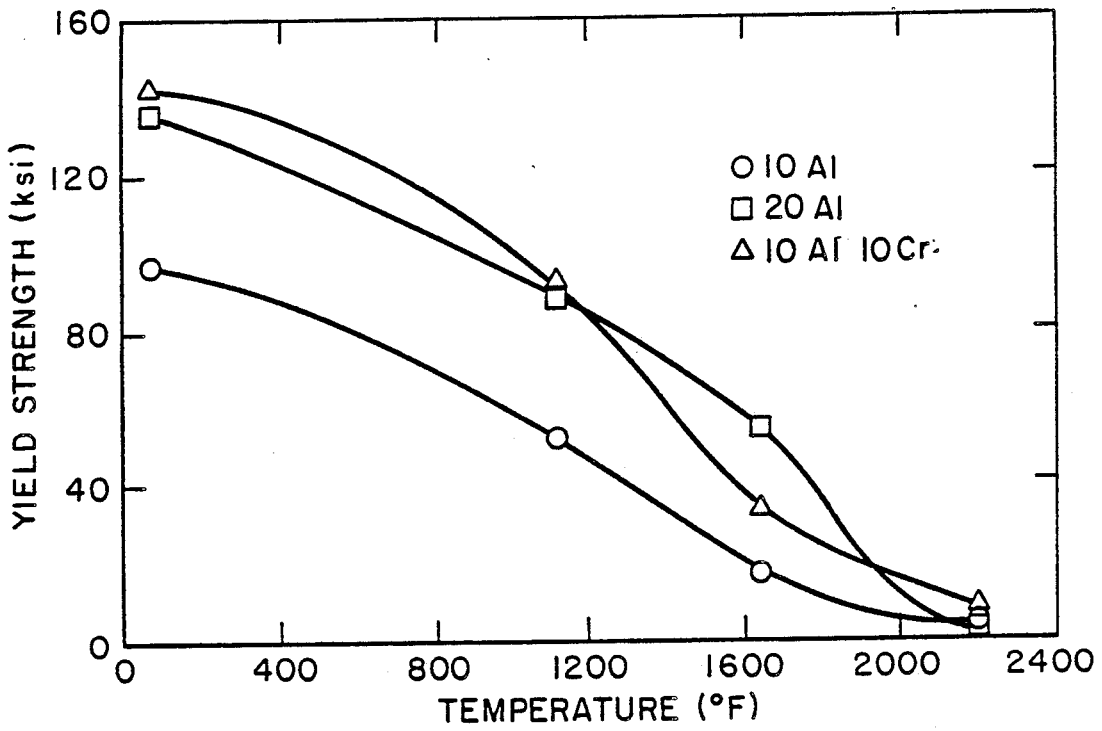
FIG. 2 is a plot of yield strength against temperature for a composition containing 10% and 20% aluminum in a niobium-titanium base and also 10% Al and 10% Cr.
Figure 3:
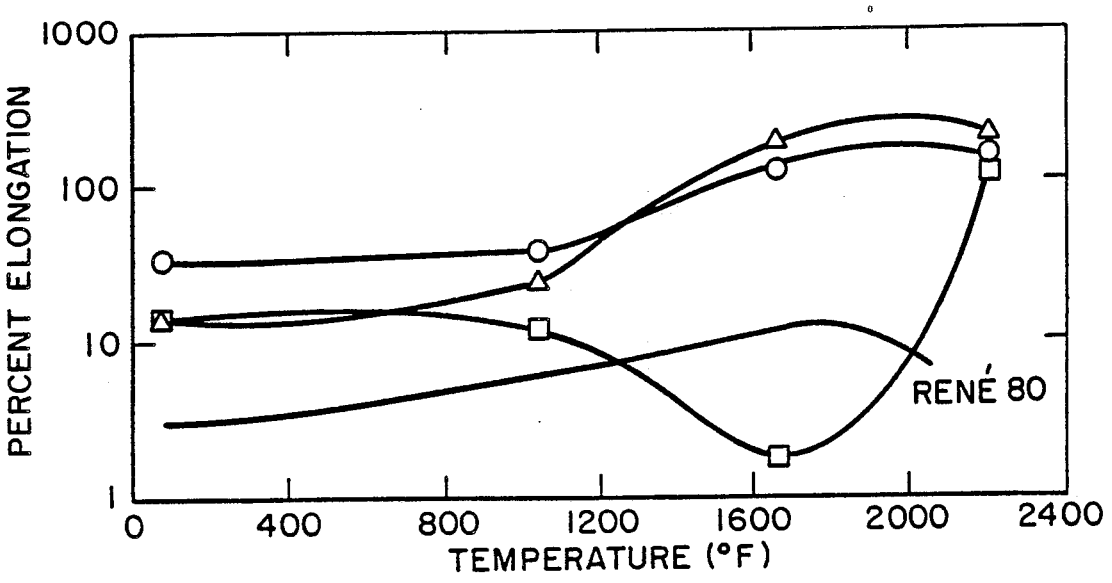
FIG. 3 is a plot of percent elongation against temperature for alloy specimens as plotted in FIG. 2. In this figure, behavior of the Ni-base superalloy Rene 80 is also plotted as a comparative to the ductility of the samples.

This and the other data from the Examples is plotted in the FIGS. 2 and 3.

Referring now particularly to FIG. 2, this figure contains a plot of the yield strength in ksi against the temperature in degrees Fahrenheit for the three alloys prepared according to Examples 2, 3, and 4 above. As is evident from the figure, the alloys each have very significant strength at room temperature. The strength decreases as the testing temperature is increased but the alloys retain a measurable strength of about 4 ksi at a temperature of 2190° F. In comparing the alloy containing 10% aluminum to that containing the 20% aluminum, it is evident that the strength of the alloy with 20% aluminum is significantly higher at all temperatures except the 2190° F. test temperature where the strength of the two alloys is about equal.

If the alloy containing 10 at. % aluminum is compared to the alloy of this invention containing 10 at. % aluminum and 10 at. % chromium, it is evident that the strength is increased at all temperatures and that the chromium containing alloy has excellent ductility.

Based on these data it is estimated that an optimum alloy might contain about 10–16 at. % aluminum and 6–12 at. % chromium for the equal proportions of the Nb and Ti as used in this series of alloys.

Referring next to FIG. 3, in this figure the percent elongation or ductility is plotted relative to the temperature in degrees Fahrenheit. Also in this figure, a graph of the elongation versus temperature is also plotted for the alloy Rene 80. It is evident that for the alloy with 10 at. % aluminum the elongation is substantially higher than that of Rene 80 at all temperatures. Also, the alloy containing 10% aluminum has a higher elongation than the alloy containing 20% aluminum at the three lower temperatures and has a slightly higher elongation than the alloy containing the 20% aluminum at the 2190° F. temperature.

By contrast the alloy containing 20% aluminum has a significant decrease in elongation at the 1650° F. temperature and at this temperature alloy containing 20% aluminum also has a lower ductility than that of Rene 80.

Rene 80 is used as a comparison here because it is a commercially available alloy which is well recognized as having very good high temperature properties and particularly high resistance to oxidation at elevated temperatures.

The chromium titanium alloy of Example 4 is seen to have higher yield strength than the alloy containing 20 at. % aluminum at every temperature except 1650° F. The chromium containing alloy also has very favorable ductility properties especially at the two higher temperatures of 1650° F. and 2190° F.

Figure 4:
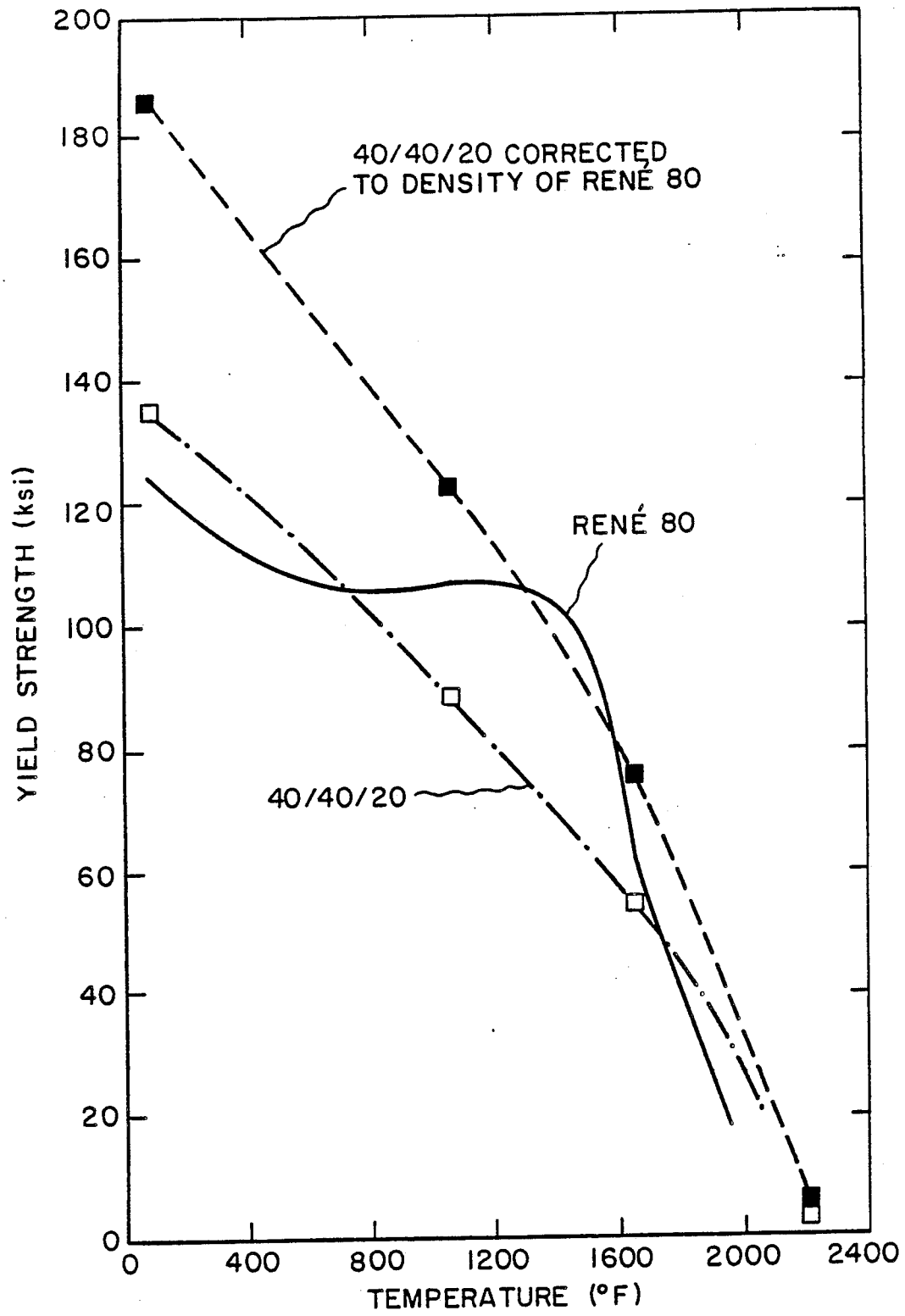
FIG. 4 is a graph of the yield strength plotted as ordinate against temperature plotted as abscissa for a number of alloys.

Referring next to FIG. 4, this figure contains graphs of the yield strength in ksi against temperature in degrees Fahrenheit for the 40/40/20 alloy containing the 20% aluminum. There are two graphs: one shown with hollow squares, and the other with filled-in squares for the alloy containing the 20% aluminum. The lower curve is based on the actual data points recorded. The upper curve is corrected to show the strength of the alloy containing 20% aluminum where a correction is made relative to the density of Rene 80. It is well known that the Rene 80 is a much heavier alloy. The 40/40/20 alloy containing 40% niobium and 40% titanium and 20% aluminum has a density advantage over the Rene 80 material as it has a lower density. The correction for density was made on the basis of the following equation:

$$\frac{\text{Density Rene' 80}}{\text{Density 40/40/20 alloy}} \times \text{strength of alloy.}$$

On the basis of this correction the specific yield strength of the 40/40/20 alloy having a density of about 5.95 g/cc is seen to be stronger than the Rene 80 alloy.

The Rene 80 alloy data is based on available data but there is no data available for the strength of this alloy at the 2190° F. temperature and so no data point or curve is shown at this temperature. However, it is believed that the 40/40/20 alloy is at least as strong as the Rene 80 at this temperature. For the most part, the chromium containing alloy is stronger still than the 40/40/20 alloy.

In this respect for airfoil applications for which mechanical loading dominates the application, airfoils of the same wall thickness as current materials would be significantly lighter than current airfoils are and such lighter airfoils would be able to withstand centrifugal self-loading if the specific yield strength comparison is matched by specific creep and rupture properties a well.

In general, thermal loading plays a major role in airfoil stress development. Thermal fatigue and thermal loading are related to $E\alpha\Delta T$ considerations. E is the elastic modulus, and $\alpha$ is the thermal expansion coefficient. The $\Delta T$ is the difference in temperature that will induce stress in a sample. The higher the $\Delta T$ the higher the stress that is induced. Where a sample is heated to a certain $\Delta T$ the stress will relate to the E and $\alpha$ of the material. Lower modulus of elasticity is preferred as lower thermal stress will result. Also, lower thermal expansion coefficient is preferred as lower thermal stress results. The niobium titanium base alloys do have both a low thermal coefficient and a low elastic modulus.

Figure 5:
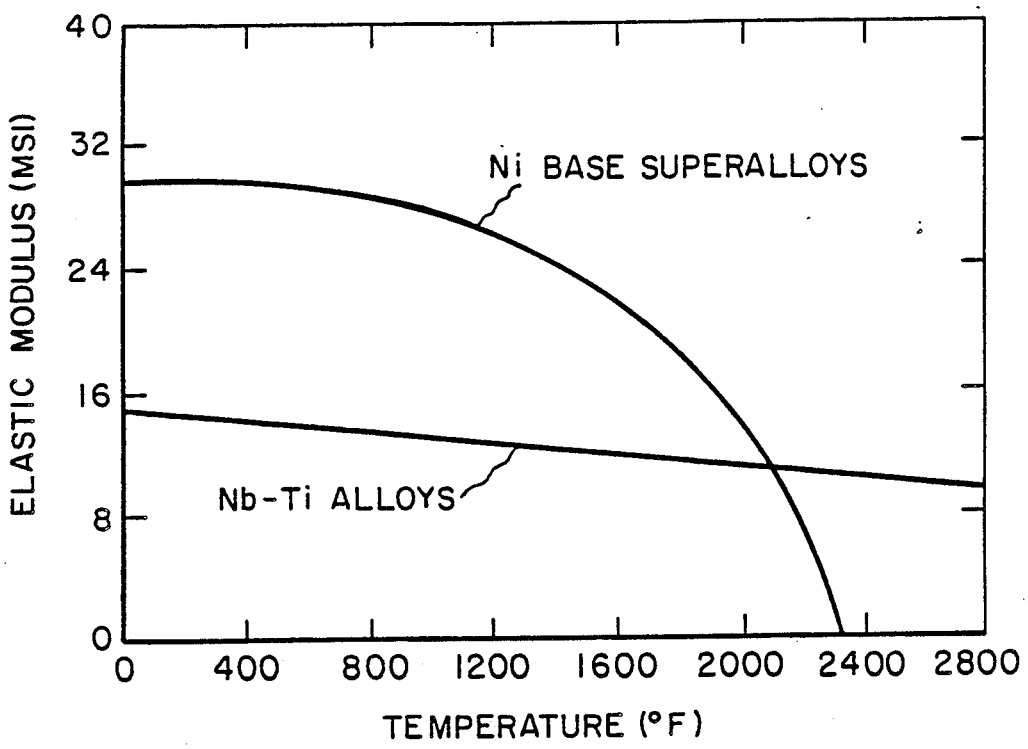
FIG. 5 is a graph of the elastic modulus in $10^6$ psi against temperature in degrees Fahrenheit for the aluminum containing niobium-titanium base alloys as compared to the nickel base superalloys.
Figure 6:
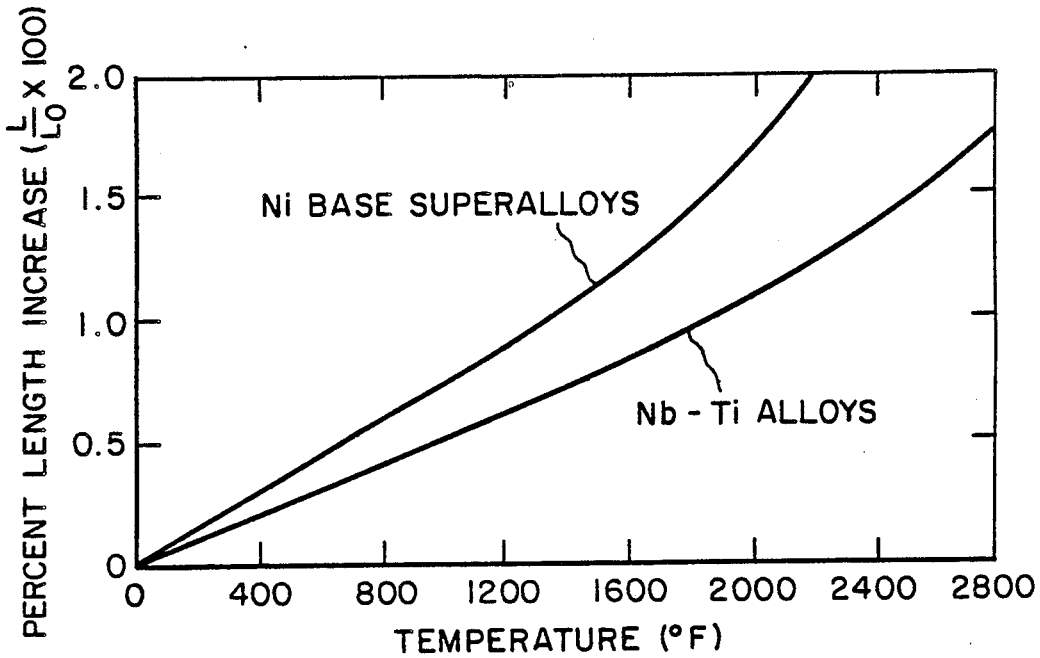
FIG. 6 is a graph in which the percent length increase is plotted against the temperature for both niobium-titanium alloys and for nickel base superalloys.

In the FIGS. 5 and 6, the comparisons of elastic modulus "E", and thermal expansion are made between the nickel base blade alloys and the niobium-titanium base alloys. These plots are approximate because E and $\alpha$ have not been measured yet at high temperature on these specific alloys. However, from the figure the ratio of $E\alpha$ for the nickel base superalloy and for a niobium-titanium base alloy indicates that thermal stresses will be reduced in the niobium-titanium base alloys to about $\frac{1}{3}$ of the level that are present in the nickel base superalloys.

The specific strength and the thermal stress considerations indicate that a major advantage exists for the niobium-titanium base alloys when compared to these considerations as applied to the nickel base superalloys. The airfoil weight reduction cascades back through the disk to provide a tremendous weight savings. This weight saving has been estimated by designers looking at the opportunity offered by lighter airfoil alloy materials such as the niobium-titanium base alloys of this invention. The weight saving can amount to about $\frac{2}{3}$ of the disk plus bucket weight as compared to present disk and bucket structures employing the nickel base alloys. This is based on an alloy density of about 5.7 g/cc.

The susceptibility of conventional Nb-Ti alloys having a high Ti content, such as that of Example 1, to oxidation and embrittlement is well known.

The aluminum and chromium additions to the niobium-titanium base alloys and the changes in the ratio of niobium to titanium to lower the concentration of titanium alters the degree of susceptibility of these alloys but does not eliminate oxidation or embrittlement.

It is known that Rene' 80 forms a shiny black oxide with extensive spalling at 2000° F. with weight loss of about 1 mg/cm$^2$ per hour of exposure. This is taken as a standard for comparison to the chromium containing alloys of this invention. Samples of the 40/40/10/10 alloy containing 40 at. % niobium, 40 at. % titanium, 10 at. % aluminum, and 10 at. % chromium were heated in air for one hour at the temperatures listed in Table V below. Oxide formation was observed, measured, and studied for evidence of spallation. The one hour treatments in air are characterized in Table V immediately below:

TABLE V

| Treatment Temperature | Character and weight of oxide | Degree of Spalling |
|---|---|---|
| 1470° F. | thin black oxide, wt. gain of 0.2 mg/cm$^2$ | no spalling |
| 1830° F. | thin blk/brown oxide wt. gain of 1.6 mg/cm$^2$ | no spalling |
| 2190° F. | thicker blk/brown oxide wt. gain of 4.0 mg/cm$^2$ | light spall. |

The use of the niobium-titanium base alloys at elevated temperatures of up to about 2200° F. is feasible. However, significant oxidation and embrittlement of these alloys can occur because of the susceptibility of the niobium-base alloys to oxidation. However, the degree of oxidation of the niobium-titanium base alloys of the subject invention are not at all typified by the oxidation behavior of the prior art niobium base commercial alloys such as Cb-752. Rather, the degree of oxidation is uniquely much lower for the aluminum and chromium containing niobium-titanium alloys of the subject invention. It is believed that the oxidation and embrittlement properties of the niobium-titanium-aluminum-chromium alloys of the subject invention can be significantly improved by coatings.

The coatings which are suggested for use with the novel alloys of the subject invention include some of the conventional protective coating materials such as the MCrAlY where the M may be nickel, cobalt or iron. However, these materials all have substantially greater thermal expansion than does NbTi. For this reason the FeCrAlY materials look most attractive because of the lower thermal coefficient of expansion, $\alpha$, for body centered cubic FeCrAlY compared to the NiCrAlY or the CoCrAlY.

By incorporating an oxide such as alumina or mullite in the FeCrAlY, the expansion matching problem can be decreased. A FeCrAl-$Al_2O_3$ coating on a niobium metal rod sample with a thin $Al_2O_3$ overcoat was subjected to 49 hours at 2100° F. in air without substantial oxidation of the substrate. After the 49-hour heating, it was observed that the alumina coating started cracking at one end of the rod and so the heating was discontinued.

EXAMPLES 5–12

Samples of an alloy of Nb, Ti, Al and Cr were prepared as described in the previous examples. The compositions of the alloy samples are set forth in Table VI immediately below:

TABLE VI

| Example | Ratio Ti/Nb | at. % Nb | at. % Ti | at. % Cr | at. % Al | Density | YS 980° C. | YS 1200° C. |
|---|---|---|---|---|---|---|---|---|
| 5 | 0.6 | 50 | 30 | 10 | 10 | | 36.6 | 13.3 |

TABLE VI-continued

| Example | Ratio Ti/Nb | at. % Nb | at. % Ti | at. % Cr | at. % Al | Density | YS 980° C. | YS 1200° C. |
|---|---|---|---|---|---|---|---|---|
| 6 | 0.6 | 47 | 28 | 10 | 15 | | 27.4 | 11.2 |
| 7 | 0.6 | 44 | 26 | 10 | 20 | | No Test | 14.6 |
| 8 | 0.6 | 42 | 28 | 15 | 10 | | 31 | 13.9 |
| 9 | 0.7 | 43.5 | 31 | 7 | 18.5 | 6.13 | 25 | 10.8 |
| 10 | 0.8 | 42 | 34 | 8 | 16 | 6.14 | 25 | 10.2 |
| 11 | 0.9 | 40 | 36 | 9 | 15 | 6.11 | 32 | 8.7 |
| 12 | 1.0 | 38 | 38 | 10 | 14 | 6.07 | 24 | No Test |
| 4 | 1.0 | 40 | 40 | 10 | 10 | | 23 | 8.4 |

Figure 7:
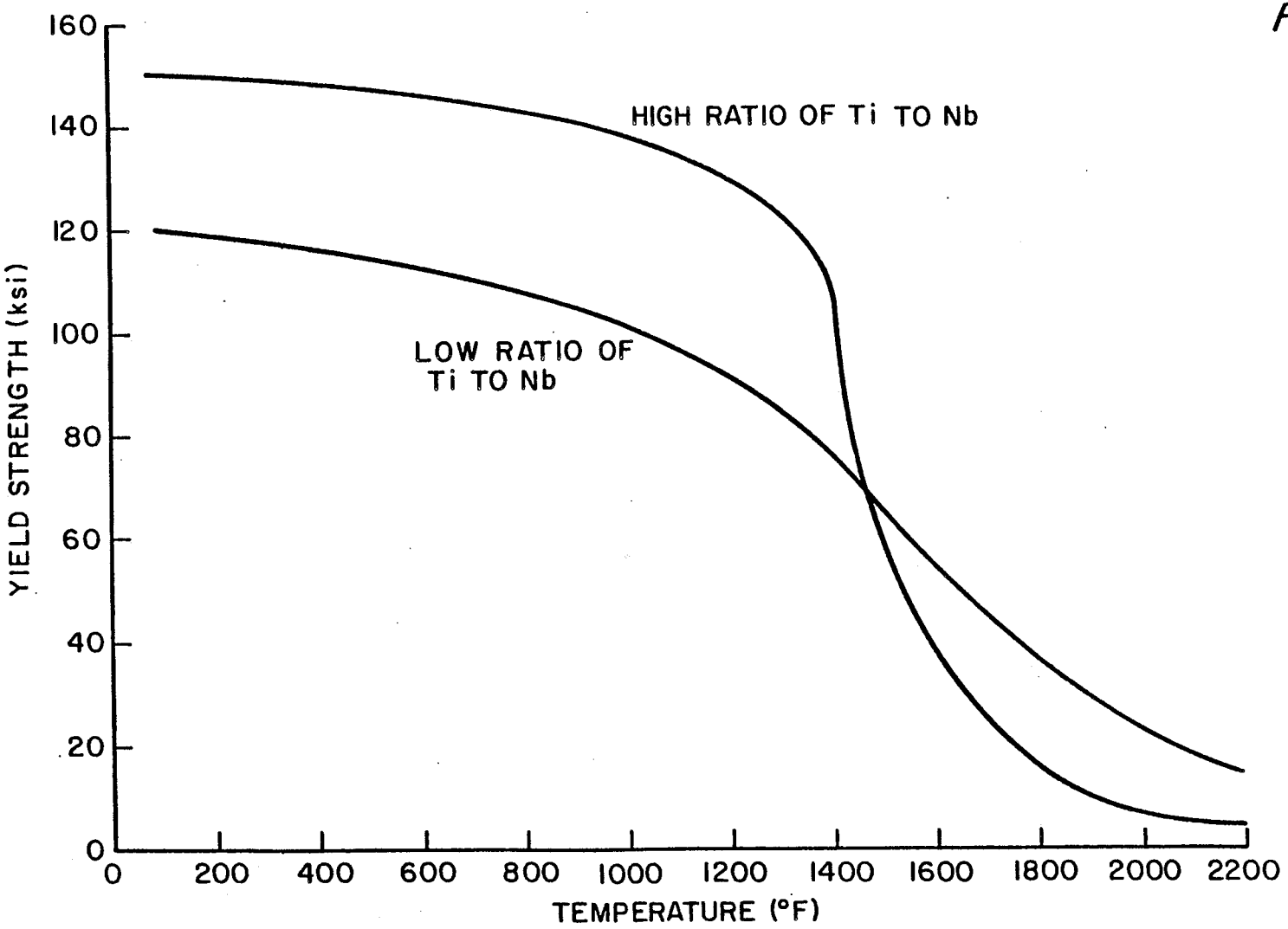
FIG. 7 is a graph in which strength as ordinate in ksi is plotted against temperature in degrees centigrade as abscissa.

From the data set forth in the above Table, it can be discerned that when the titanium to niobium ratio is quite low and of the order of about 0.6 that the high temperature properties of the alloy tend to be better. This is evidenced by the yield strength at 1200° C. in the last column where the strength is given as double digit values. By contrast, where the titanium to niobium ratio is higher and of the order of 0.9 or 1.0, it is evident from the data that the high temperature properties are lower and in the case of the yield strength at 1200° C. that the figures are single digit values. The different properties of the alloy which relate to the atomic ratio of Ti to Nb are related also to the solubility of aluminum and chromium in the niobium titanium base alloy. The higher the Ti/Nb ratio the higher the concentration of titanium and the greater the solubility of aluminum and chromium in the base alloy. In a qualitative sort-of-way, FIG. 7 illustrates the relationship between the strength of the material and the temperature of the material. For the materials having a high titanium to niobium ratio, the strength is highest at lowest temperatures but decreases more rapidly than the material which has the lower titanium to niobium ratio over a temperature range of up to about 2200° F.

To maintian low temperature ductility, it is necessary to restrict the total Al+Cr contents. The degree of this necessary restriction varies with the Ti/Nb ratio.

For optimum high strength at low temperatures, below about 1400° F., a high titanium to niobium ratio is needed. The high titanium concentration permits additions summing up to about 22 atom percent aluminum and chromium without degrading low temperature ductility. For optimum high strength at high temperatures, above about 1400° F., a lower ratio of titanium to niobium is needed. In alloys having less than 37 atomic percent titanium, concentrations of aluminum and chromium should not exceed 16 atom percent or the alloy will become brittle. These relationships of strength at various temperatures for the compositions with higher and lower ratios of titanium to niobium are illustrated graphically in FIG. 7.

What is claimed is:

1. A composition of matter consisting essentially of niobium, titanium, aluminum and chromium in the approximate concentration in atomic percent as follows:

| Ingredient | Concentration in Atomic Percent From | To |
|---|---|---|
| Nb | balance | |
| Ti | 32 | 48 |
| Al | 8 | 16 |
| Cr | 2 | 12 |

provided that the sum (Al+Cr)≦22%, and where Ti is less than 37 a/o the sum (Al+Cr)≦16 a/o.

2. The alloy of claim 1, in which the alloy contains 32–36.9 Ti, 8–12 Al, 2–8 Cr, balance Nb, with the sum (Al+Cr)≦16 a/o.

3. A composition of matter consisting essentially of niobium, titanium, aluminum and chromium in the approximate concentration in atomic percent as follows:

| Ingredient | Concentration in Atomic Percent From | To |
|---|---|---|
| Nb | balance | |
| Ti | 32 | 48 |
| Al | 8 | 16 |
| Cr | 2 | 12 |

provided that the alloy contains 42.5–48 Ti, 8–16 Al, 2–10 Cr, balance Nb, with the sum (Al+Cr)≦22 a/o.

4. A composition of matter consisting essentially of niobium, titanium, aluminum and chromium in the approximate concentration in atomic percent as follows:

| Ingredient | Concentration in Atomic Percent From | To |
|---|---|---|
| Nb | balance | |
| Ti | 32 | 48 |
| Al | 8 | 16 |
| Cr | 2 | 12 |

provided that the alloy contains 37–42.4 Ti, 8–14 Al, 2–10 Cr, balance Nb, with the sum (Al+Cr)≦22 a/o.

* * * * *